US006176164B1

(12) United States Patent
Nylander

(10) Patent No.: US 6,176,164 B1
(45) Date of Patent: Jan. 23, 2001

(54) COMPRESSION CUTTING PROCESS FOR FLEXIBLE FORM AND TEMPLATE FOR USE THEREWITH

(76) Inventor: Robert B. Nylander, 1469 Mayapan Rd., La Habra Heights, CA (US) 90631

( * ) Notice: Under 35 U.S.C. 154(b), the term of this patent shall be extended for 0 days.

(21) Appl. No.: 09/374,924

(22) Filed: Aug. 16, 1999

(51) Int. Cl.[7] ..... B26D 7/14
(52) U.S. Cl. ..... 83/21; 83/176; 83/19
(58) Field of Search ..... 83/17, 18, 19, 83/20, 21, 175, 176, 870, 871, 872

(56) References Cited

U.S. PATENT DOCUMENTS

| | | | | |
|---|---|---|---|---|
| 1,145,654 | * | 7/1915 | Anderson | 128/894 |
| 2,404,731 | * | 7/1946 | Johnson | 12/14 M |
| 2,902,091 | * | 9/1959 | Dahle | 83/18 |
| 3,186,271 | * | 6/1965 | Kaiser | 83/874 |
| 3,197,357 | * | 7/1965 | Schulpen | 428/158 |
| 3,431,802 | * | 3/1969 | Schulpen | 83/874 |
| 3,518,906 | * | 7/1970 | Alberektson | 83/861 |
| 3,665,792 | * | 5/1972 | Bush et al. | 83/1 |
| 3,690,203 | * | 9/1972 | Huttemann | 83/1 |
| 3,695,128 | * | 10/1972 | Gentile | 83/1 |
| 3,730,031 | * | 5/1973 | Huttemann | 83/4 |
| 4,230,521 | * | 10/1980 | Cobb et al. | 156/549 |
| 4,351,211 | * | 9/1982 | Azzolini | 83/861 |
| 4,543,862 | * | 10/1985 | Levene et al. | 83/19 |
| 5,523,040 | * | 6/1996 | Krouskop | 264/163 |
| 5,534,208 | * | 7/1996 | Barr et al. | 264/160 |

* cited by examiner

*Primary Examiner*—M. Rachuba
*Assistant Examiner*—Kim Ngoc Tran
(74) *Attorney, Agent, or Firm*—Edgar W. Averill, Jr.

(57) ABSTRACT

A process for the compression cutting of foam which uses a moving table which supports a template over which a foam block to be cut is placed. The foam block and template are moved under an angled moving belt compressed and passed against a moving blade. The improvement of the present invention includes the step of placing a second foam block above the foam block to be cut and passing both the foam block to be cut and the second block under the moving belt and cutting only the foam block to be cut. Next, the second foam block is removed and placed on top of the template and becomes a foam block to be cut and a new second foam block is placed over the block to be cut and the process is repeated. The template has a flat base with removable form members affixed to its upper surface. Then, when the template becomes worn, a new base board and sidewall can easily be formed and the removable form members removed from the worn form and placed on the upper surface of the base of the replacement template.

7 Claims, 2 Drawing Sheets

COMPRESSION CUTTING PROCESS FOR FLEXIBLE FORM AND TEMPLATE FOR USE THEREWITH

BACKGROUND OF THE INVENTION

The field of the invention is foam compression cutting and the invention relates more particularly to an improved foam cutting process capable of very detailed and sharp-edged cuts. Compression foam cutting is itself not a new process and has been carried out in various forms for many years.

U.S. Pat. No. 4,351,211 shows a foam cutting process utilizing the compression of a piece of foam between two dies, each of which support four members and a cut is made through a middle portion of the compressed foam block.

U.S. Pat. No. 5,523,040 shows a method for making a custom support cushion where a foam block is compressed by a seated person and a cut made.

U.S. Pat. No. 5,688,538 shows a foam cutting process utilizing a pair of rollers having a blade downstream of a nip between rollers.

A process utilizing a moving table that supports a template has also been used for many years and will be described below in conjunction with the drawings.

BRIEF SUMMARY OF THE INVENTION

It is an object of the present invention to provide a compression cutting process capable of forming a cut foam block with far more detail than heretofore thought possible.

The present invention is for a process for the compression cutting of foam of the type which utilizes a moving table which supports a template which has a shaped template cavity. An angled moving belt is supported above the template and the foam block placed on the upper surface of the template is fed under the moving belt and compressed. A moving knife is positioned downstream of the angled moving belt and makes a cut in the compressed foam block. The improvement of the present invention includes the steps of placing a second block above the foam block to be cut over the template to form a sandwiched pair of identical foam blocks. The template and sandwiched pair of identical foam blocks are passed into the lower feed area of the angled moving belt and compressed so that the moving blade cuts the foam block to be cut to create a cut foam block but does not cut the second foam block. The resulting cut foam block is removed and the second foam block is removed and placed on the upper surface of the template to make it a foam block to be cut and a new second foam block is placed on the upper surface thereof to form a new sandwiched pair of identical foam blocks. The process is then repeated. Preferably, the foam is compressed to at least a ratio of 6 to 1, and preferably, about 32 to 1. The template used in the process of the present invention preferably is made using flat base board surrounded by a wall portion with an abrasion-resistant upper surface. A plurality of removable form members are affixed to the base board. When the abrasion-resistant upper surface is worn through, a new base board and new wall portion can readily be supplied and the removable form members can be removed from the worn template and placed on the base board of the new template.

DESCRIPTION OF THE PREFERRED EMBODIMENTS

Figure 1:
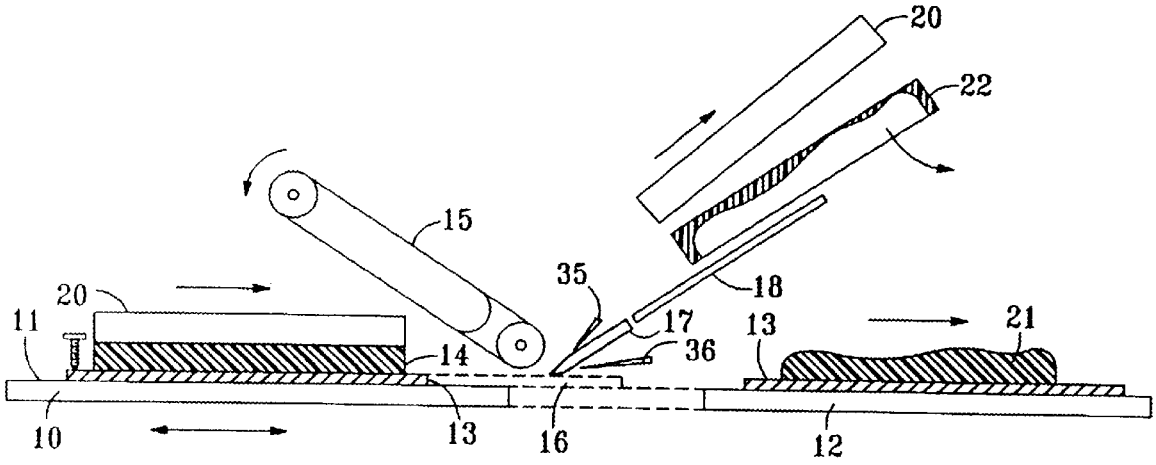
FIG. 1 is a side view of the process of the present invention.

FIG. 1 shows the improved process of the present invention which utilizes equipment which, in an unmodified state, has been used for many years. The prior art portions of the equipment include a moving table which reciprocates back and forth from a pre-cut position 11 to a post-cut position 12. A template 13 is affixed to an upper surface of moving table 10 and in the past, a single foam block was placed on the top of the template and moved under a moving feed belt 15 which compresses the foam into a lower feed area 16. A moving blade 17 is held between two knife beams 35 and 36 which are preferably fabricated from a polymer with a low coefficient of friction, such as the fluorcarbon resin sold under the trademark Teflon and which held convey the cut foam outwardly from the moving blade 17.

The process of the present invention includes the step of placing a second foam block 20 on top of the foam block to be cut 14 and adjusting the height of feed belt 15 so that the foam is compressed at least to a ratio of 6 to 1. This forms a sandwich of two identical foam blocks, only the lower of which is cut in the process. After passing through blade 17, a lower cut portion 21 remains on the template 13 and an upper cut portion 22 is fed over the upper surface of the guide plate 18 by beam 35. Depending upon the desired product, either the lower cut portion 21 or the upper cut portion 22 can be the desired end product. Second foam block 20 passes under lower feed area 16 without any cutting, but is changed by being compressed and allowed to expand. This pre-conditioning permits the foam block to be more easily cut. This foam block 20 is then used as the lower foam block to be cut 14 and a new second foam block 20 is placed on the upper surface after the table has been reciprocated to its pre-cut position 11.

Figure 2:
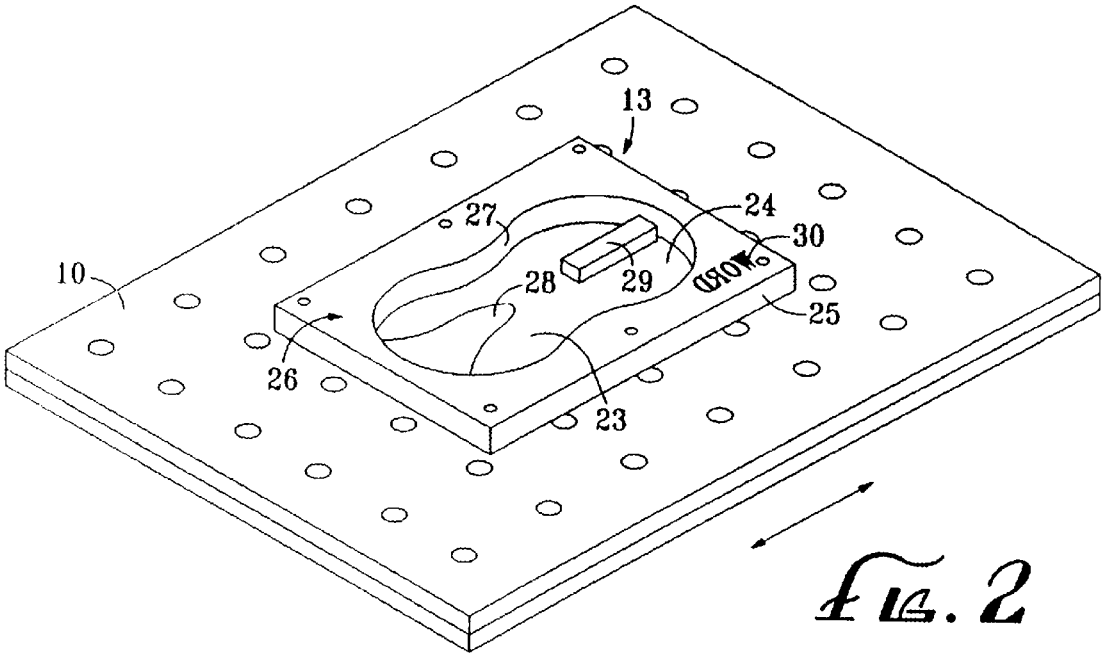
FIG. 2 is a perspective view showing the moving table and template useful with the process of the present invention.

The details of the template are shown best in FIG. 2 of the drawings. Template 13 has a base board 23 having an upper surface 24. A side wall portion 25 is secured to base board 23 and has a top surface 26 which is made from an abrasion-resistant material such as a melamine polymer. The side wall portion 25 has a shaped opening 27 which exposes a portion of the upper surface 24 of base board 23. A plurality of removable form members 28 and 29 are affixed using, for example, double sided tape to upper surface 24. The top surface 26 is in contact with the moving blade and eventually, the Melamine portion wears through. In the past, when this happened, an entire new template would have to be formed. Utilizing the novel form of the present invention, one can merely provide a new flat base board 23, cut a shaped opening 27 in a melamine surfaced side wall portion 25. Next, the form members are simply lifted out of the worn form and placed on the floor of the new template. A trademark word or other detailed indicia may be also formed in the template as indicated at reference character 30.

Figure 3:
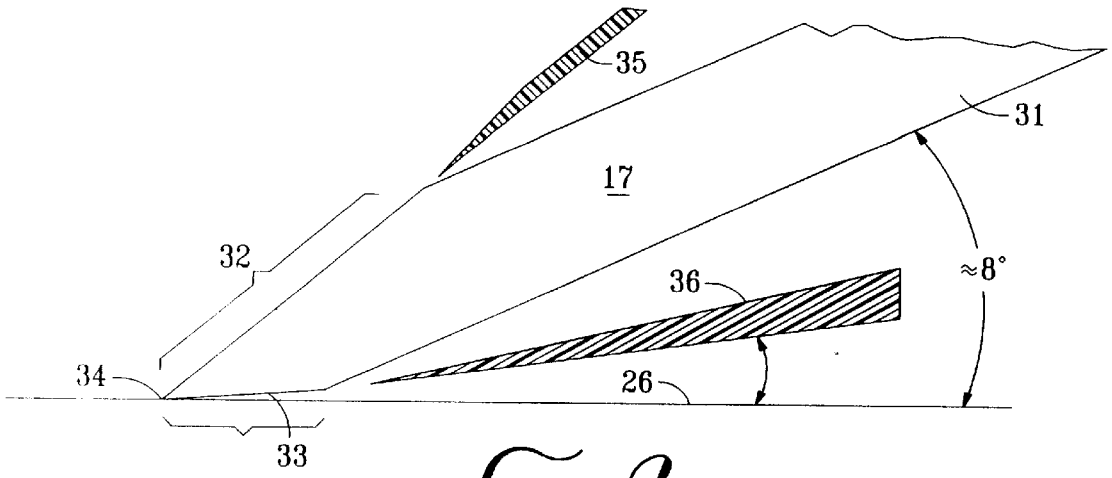
FIG. 3 is an enlarged cross-sectional view of the blade assembly useful with the process of the present invention.

The detail of the blade construction is shown in FIG. 3 where blade 17 is similar to a band saw blade without any teeth. It has a flat body portion 31 which is oriented at an angle of about 8° with respect to the upper surface of the template. Blade 17 has an upper bevel 32 which should be at least 6 mm. in width. The blade has a lower bevel 33 which is angled at about 8° with respect to the top surface

26. The lower level is preferably about ½ mm in width. The tip of the blade 34 touches the top surface 26 and eventually wears through the Melamine layer. A pair of knife beams comprising an upper knife beam 35 and a lower knife beam 36 guide the cut foam away from blade 17. The are preferably made from a polymer having a high degree of slip such as a fluorcarbon polymer.

Figure 4:
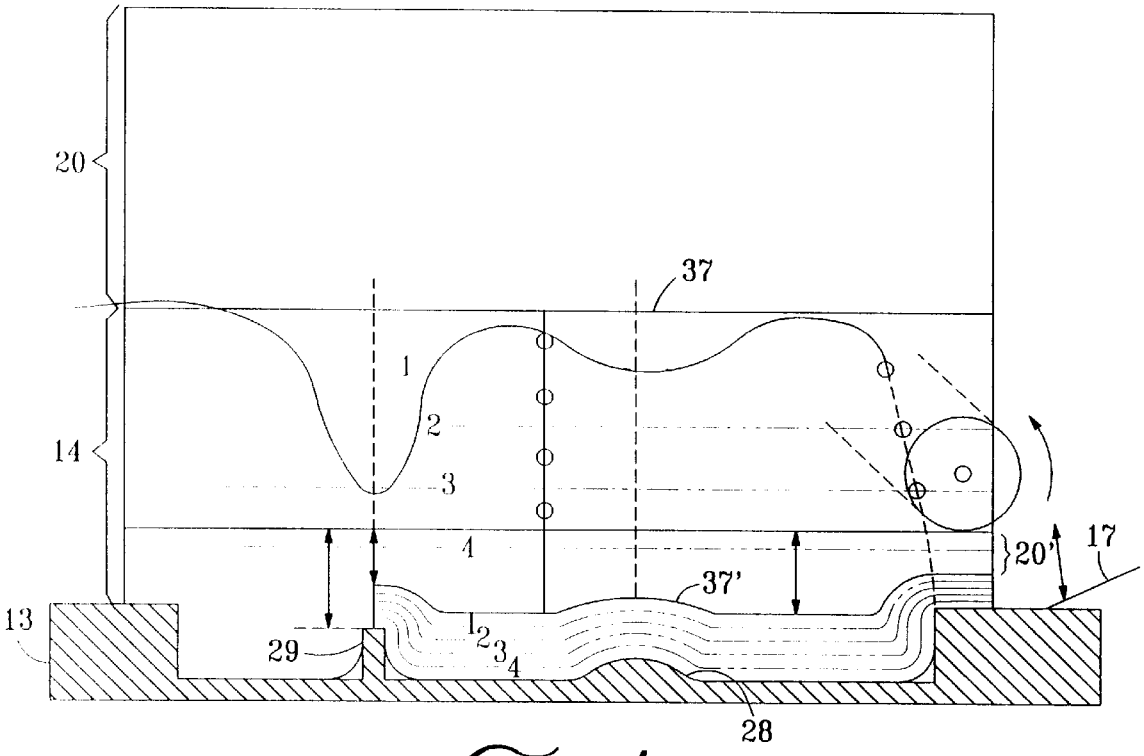
FIG. 4 is a diagrammatic cross-sectional side view showing the result of the compression cutting process of the present invention.

The cutting process is indicated diagrammatically in FIG. 4 as if the foam were evenly compressed. In reality, it is compressed only under the feed area of the moving belt, but an understanding of the resulting shape is more easily accomplished by showing diagrammatically as an even compression. In FIG. 4 the upper or second foam block 20 is shown sandwiched with the foam block to be cut 14. Four horizontal lines 1, 2, 3 and 4 are indicated on block 14 prior to compression. After compression, lines 1, 2, 3 and 4 are indicated on the right hand side of FIG. 4 pressed into the opening in the template. The compressed upper block 20' is also indicated on the right hand side of FIG. 4 and it can be seen that the lowermost portion of the compressed upper foam block is still above knife blade 17. It can also be seen that the upper foam block presses the interface 37 prior to compression and 37' after compression into a shape that assists the movement of the foam block to be cut into the cavity in the template. In other words, if one were to take a flat pressure plate, this interface would be flat, but with the use of an upper or second block, the amount of compression is significantly increased and the detail and the resulting cut foam is far more exact.

Typically, foam with a density of at least one pound per cubic foot would be useful with the process of the present invention. It is also possible to use a higher foam density with the process of the present invention with a density of 4 lbs. per cubic foot providing a finished cut foam block of remarkable accuracy. Also, the compression is preferably much higher than previously attained with this type of equipment. A normal compression is about 6 to 1 whereas the compression of the process of the present invention can be as high as 35 to 1 with 32 to 1 being preferred. It can also be seen that the use of a second foam block eliminates the possibility of the blade rubbing against the moving belt and at worst, a small amount of the upper foam block would be cut if the compression were too high. A typical foam block would pass under the blade for between 3–5 seconds. This speed is reduced if sharper vertical cuts are desired. The process of the present invention permits the formation of very readable lettering or trademarks. Lettering having a height of as little as ¼" is still easily read.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A process for the compression cutting of foam of the type utilizing a moving table which supports a template including a shaped template cavity, said process further including an angled moving feed belt having a lower feed area positionable near a flat upper surface of said template for compressing a foam block to be cut and a moving blade position adjacent and downstream of said lower feed area to make a cut in said foam block wherein the improvement comprises:

placing a second foam block above the foam block to be cut over said template to form a sandwiched pair of identical foam blocks;

passing the template and the sandwiched pair of identical foam blocks into the lower feed area and adjusting the compression so that the moving blade cuts the foam block to be cut to create a cut foam block but does not cut the second foam block;

removing the resulting cut foam block; and taking the second foam block, after it has passed under the lower feed area and placing the second foam block on the template to make it a block to be cut then placing a new identical second foam block over the block to be cut and repeating the steps from said passing step.

2. The process for the compression cutting of foam of claim 1 wherein the foam is compressed to a compression of at least 6 to 1.

3. The process for the compression cutting of foam of claim 2 wherein the foam is compressed to about 32 to 1.

4. The process for the compression cutting of foam of claim 1 wherein the foam has a density of at least 4 lbs. per cubic foot.

5. The process for the compression cutting of foam of claim 1 wherein said template has a flat floor surface and has a plurality of removable protrusions releasably held to said flat floor surface.

6. The process for the compression cutting of foam of claim 1 wherein the moving blade has a bottom surface which is positioned at an angle of about eight degrees with respect to the template upper surface.

7. The process for the compression cutting of foam of claim 6 wherein said blade has a cutting configuration including a beveled upper portion about six millimeters wide, a lower portion of about one half millimeter in width and the body of the blade is angled at about 8 degrees with respect to the flat upper surface of said template.

* * * * *